US007175216B1

(12) United States Patent
Tong et al.

(10) Patent No.: US 7,175,216 B1
(45) Date of Patent: Feb. 13, 2007

(54) LATCH MECHANISM

(75) Inventors: Zhanmin Tong, Singapore (SG); Chin Chye Tan, Singapore (SG)

(73) Assignee: NSL Engineering Pte. Ltd., Singapore (SG)

( * ) Notice: Subject to any disclaimer, the term of this patent is extended or adjusted under 35 U.S.C. 154(b) by 226 days.

(21) Appl. No.: 10/416,279

(22) PCT Filed: Nov. 10, 2000

(86) PCT No.: PCT/SG00/00187

§ 371 (c)(1),
(2), (4) Date: Sep. 29, 2003

(87) PCT Pub. No.: WO02/38486

PCT Pub. Date: May 16, 2002

(51) Int. Cl.
*B66C 1/00* (2006.01)

(52) U.S. Cl. ..... 294/81.1; 294/81.53

(58) Field of Classification Search ..... 294/81.1, 294/81.53, 86.23, 82.34; 292/25, 26, 96, 292/97; 403/421
See application file for complete search history.

(56) References Cited

U.S. PATENT DOCUMENTS 3,015,407 A * 1/1962 Fesmire et al. ..... 220/1.5
3,399,921 A * 9/1968 Trost et al. ..... 410/69
3,493,258 A * 2/1970 Wyrough ..... 294/81.53
3,829,145 A * 8/1974 Gottlieb et al. ..... 294/81.41
3,874,719 A * 4/1975 Goyarts ..... 414/460
3,899,092 A * 8/1975 Nordstrom ..... 410/87
3,980,185 A * 9/1976 Cain ..... 206/509
4,221,515 A * 9/1980 Brown et al. ..... 410/32
4,244,615 A 1/1981 Brown ..... 294/67
4,341,495 A * 7/1982 Del'Acqua ..... 410/78

(Continued)

FOREIGN PATENT DOCUMENTS

EP 0639527 2/1995

*Primary Examiner*—Eileen D. Lillis
*Assistant Examiner*—Esther Onyinyechi Okezie
(74) *Attorney, Agent, or Firm*—Ostrolenk, Faber, Gerb & Soffen, LLP

(57) ABSTRACT

A latch mechanism (7) includes a latch member (8) movable between a release position and a latched position, an operating member (34) movably coupled to the latch member (8), the operating member (34) being movable between a first position and a second position and the latch member (8) being in the release position when the operating member (34) is in the first position and the latch member (8) being in the latched position when the operating member (34) is in the second position. An actuating member (32) movable from a first position to a second position. Movement of the actuating member (32) from the first position to the second position causing the operating member (34) to move from the first position to the second position. A lock member (41) locks the operating member (34) in the second position and the lock member (41) moves from the disengaged position to the engaged position when the operating member (34) is moved from the first position to the second position. A release member (10) is movable between a first and a second position, movement of the release member from the first position to the second position, when the lock member is in the engaged position, causing the lock member to move from the engaged to the disengaged position to permit the operating member to move from the second position to the first position. The actuating member (32) and the operating member (34) are movably mounted on each other.

10 Claims, 11 Drawing Sheets

U.S. PATENT DOCUMENTS 4,372,597 A * 2/1983 Stillman et al. ..... 294/81.4
4,521,044 A * 6/1985 Appleman et al. ..... 294/82.24
4,610,474 A * 9/1986 Jaatinen ..... 294/82.27
5,163,726 A 11/1992 Boos et al. ..... 294/81.1
5,470,189 A 11/1995 Baumann et al. ..... 414/618
6,135,524 A * 10/2000 Faller et al. ..... 294/81.1

* cited by examiner

LATCH MECHANISM

The invention relates to a latch mechanism, and especially, a latch mechanism for use with spreaders for handling the freight containers.

Spreaders are commonly used to move freight containers from a first position to a second location. Such as between a ship and quay or dockside, or onto a transporter. A typical spreader includes a metal frame with twistlocks at each corner, which are adapted to locate in corresponding apertures in the top side of a container. After the twistlocks are located in the twistlock apertures, the twistlocks are rotated to lock the container to the spreader so that the container can be hoisted by lifting the spreader.

However, if freight or cargo is secured to the top surface of a flat pallet, if cargo protrudes from the top of an open top container or if cargo protrudes above the end frames of a "flatrack" type container, it may not be possible for a conventional spreader to engage with the twistlock apertures on the pallet, open top container or flatrack. This is because the twistlock apertures are level with the surface of the pallet and the freight or cargo secured on top of the pallet prevents the spreader being lowered to engage with the twistlock apertures.

Therefore, an attachment known as an overheight attachment (or overheight spreader) is commonly used to couple a pallet to the spreader. The overheight attachment comprises a frame that has twistlock apertures in its top side that can be engaged by the twistlocks on the spreader. Four legs extend from the upper frame of the overheight attachment and have twistlocks on the lower ends that can be engaged with the twistlock apertures on the pallet. Each leg of the overheight attachment has a mechanism which enables the twistlocks at the lower ends of the legs to be rotated by rotation of the twistlocks on the spreader. Therefore, the overheight attachment effectively form an extension to the spreader twistlocks to enable a pallet with cargo secured to it to be picked up by the spreader.

As rotation of the twistlock elements on the spreader is used to rotate the twistlock elements at the lower ends of the legs of the overheight attachment, it is essential to have a separate latch mechanism to secure the spreader to the overheight attachment, so that when the twistlocks are counter-rotated to unlock the overheight attachment from the pallet, the spreader still remains secured to the overheight attachment to permit the overheight attachment to be detached from the pallet and hoisted by the spreader.

Conventionally, overheight attachments are releasably attached to the spreader by landing the spreader on the overheight attachment and coupling the overheight attachment to the spreader using pins inserted manually into aligned apertures on the spreader and the overheight attachment to secure the spreader to the overheight attachment. Therefore, this requires personnel to be on the ground to insert the pins.

One solution at overcoming the problem of having to manually insert pins is disclosed in U.S. Pat. No. 5,163,726. However, this system has the disadvantage that it requires the spreader to be landed on the overheight attachment to pick up the overheight attachment from a base frame using the twistlock elements in the spreader to engage with the overheight attachment, and to then reland the overheight attachment on the base frame in a second position to actuate a latch mechanism to secure the spreader to the overheight attachment. Accordingly, this system requires the overheight attachment to be engaged with the spreader, picked up and then relanded on the base frame to lock the spreader to the overheight attachment. For disengagement, the system requires the coupled spreader and overheight attachment to be landed on the base frame in the second position to deactivate the latch mechanism. The overheight attachment is then picked up using the twistlocks on the spreader and relanded on the base frame in the first position and the twistlocks disengaged from the overheight attachment to facilitate disengagement of the spreader from the overheight spreader.

In accordance with the present invention, a latch mechanism comprises a latch member movable between a release position and a latched position, an operating member movably coupled to the latch member, the operating member being movable between a first position and a second position, the latch member being in the release position when the operating member is in the first position and the latch member being in the latched position when the operating member is in the second position, an actuating member movable from a first position to a second position, movement of the actuating member from the first position to the second position causing the operating member to move from the first position to the second position to move the latch member from the release position to the latched position, a lock member movable between a disengaged position and an engaged position in which the lock member locks the operating member in the second position, the lock member moving from the disengaged position to the engaged position when the operating member is moved from the first position to the second position, and a release member movable between a first and a second position, movement of the release member from the first position to the second position, when the lock member is in the engaged position, causing the lock member to move from the engaged to the disengaged position to permit the operating member to move from the second position to the first position, and wherein the actuating member and the operating member are movably mounted on each other.

Preferably, the actuating member and the operating member are slidably mounted on a support member and typically, are concentrically mounted on the support member.

Preferably, the operating member is biased to the first position.

Preferably, the actuating member is biased to the first position.

Typically, the release member is biased to the first position.

Preferably, the actuating member includes an engagement member which is movable between a first position in which the engagement member is adapted to engage with the operating member, and a second position in which the engagement member is disengaged from the operating member when the actuating member is in the second position.

Preferably, the lock member is biased to the engaged position.

Preferably, the operating member is coupled to the latch member by an intermediate link that is preferably, pivotally coupled to the operating member and slidably coupled to the latch member.

In accordance with a second aspect of the present invention, an overheight attachment for a spreader comprises a latch mechanism in accordance with the first aspect of the invention.

In accordance with a third aspect of the present invention, a system for handling cargo comprises a spreader and an overheight attachment in accordance with the second aspect of the invention, the spreader actuating the actuating member when the spreader is engaged with the overheight attachment to move the actuating member from the first to the second position to cause the latch member to engage with a latching formation on the spreader.

An example of a latch mechanism in accordance with the invention will now be described with reference to the accompanying drawings in which.

Figure 1:
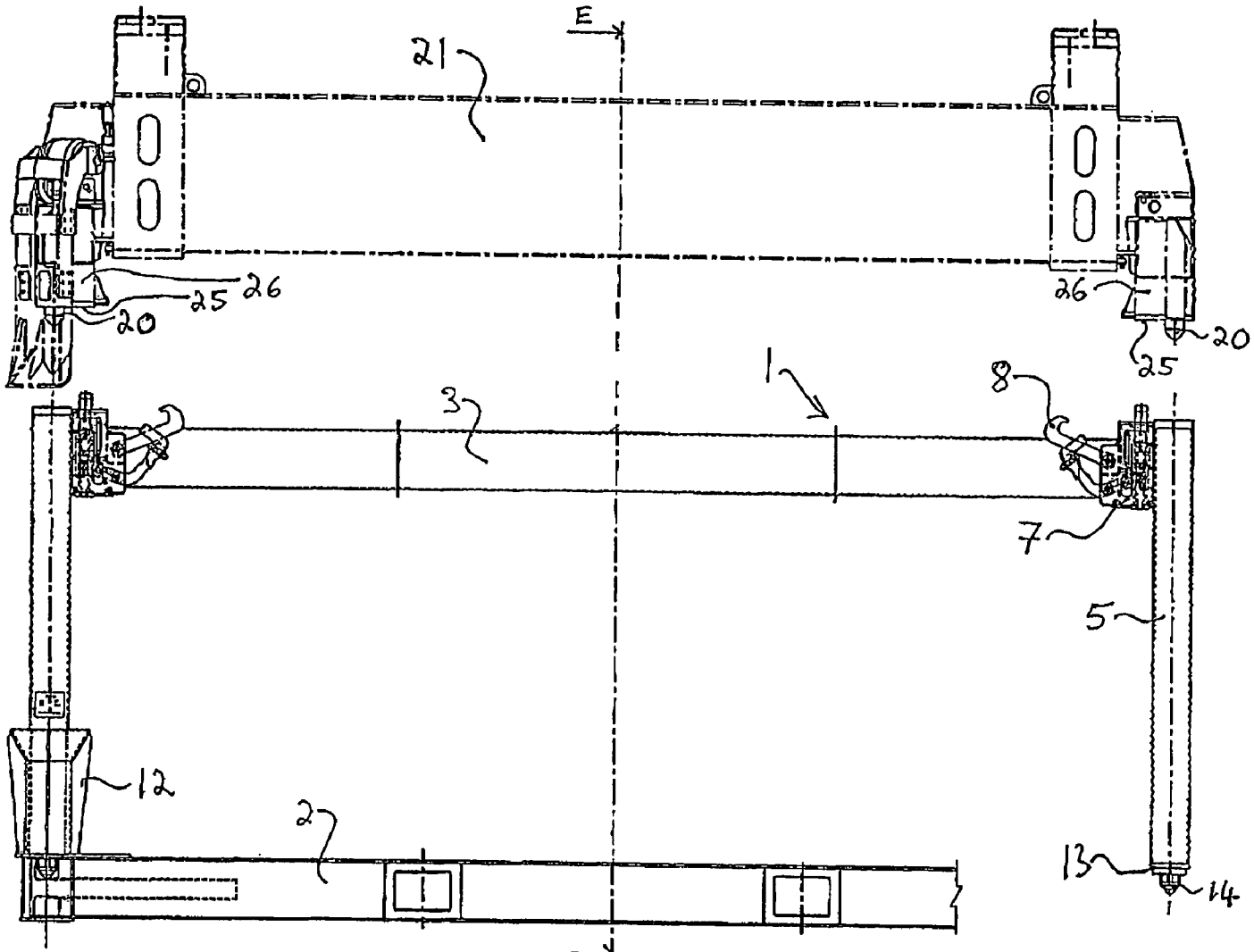
FIG. 1 is a side view of a spreader and an overheight attachment mounted on a base frame and with the spreader disengaged from the overheight attachment.
Figure 2:
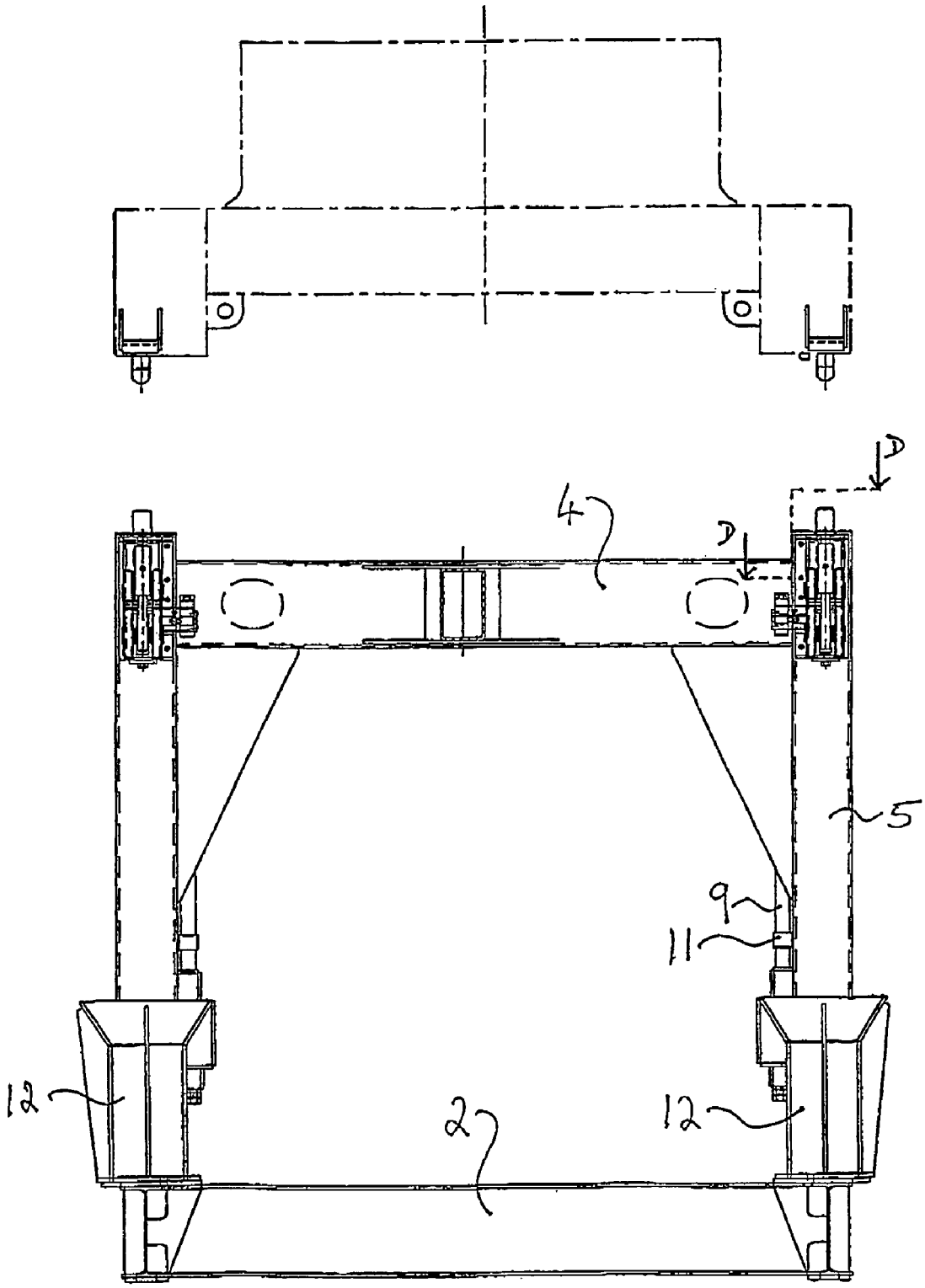
FIG. 2 is a cross-sectional view along the line E—E of FIG. 1.

FIG. 1 shows an overheight attachment 1 mounted on a base frame 2. The overheight attachment 1 includes a central cross member 3 and two end members 4 arranged such that the cross member 3 and the two end members 4 form an "H" shape. At each end of the cross members 4 is a leg 5 at the top of which is a twistlock aperture 6. Mounted on each of the legs 5 is a latch mechanism 7, which includes a latch member 8. Extending down the inside of each leg 5 is a push rod 9. The upper end of the push rod 9 terminates in a lever 10 and the push rod 9 is slidably mounted on the legs 5 by retaining rings 11, and has a helical spring 50 located between the upper ring 11 and a shoulder 51. The spring 50 is compressed in the position shown in FIGS. 4 and 5. The base frame 2 includes four leg receiving sections 12 which receive lower ends 13 of the legs 5 and twistlock elements 14 located at the lower end 13 of the legs 5. When the overheight attachment 1 is fully landed on the base frame 2, as shown in FIGS. 1 to 6, a lower end 15 of the push rod 9 buts against a stop 16 mounted on each of the leg receiving sections 12.

The twistlock apertures 6 in the upper ends of the legs 5 are adapted to receive twistlocks 20 mounted on twistlock corners 26 on a spreader 21. Adjacent to each of the twislocks 20 is a latch formation 22 which is adapted to be engaged by the latch member 8 when the spreader 21 is landed on the overheight attachment 3 by engaging the twistlocks 20 in the twistlock aperture 6.

Figure 3:
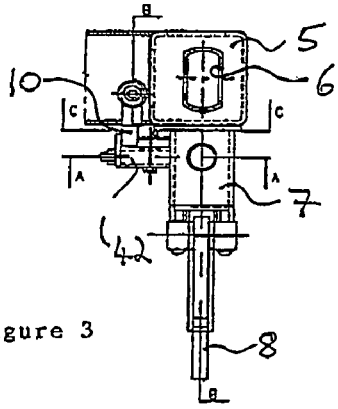
FIG. 3 is a partial cross-sectional view along the line D—D of FIG. 2.
Figure 6:
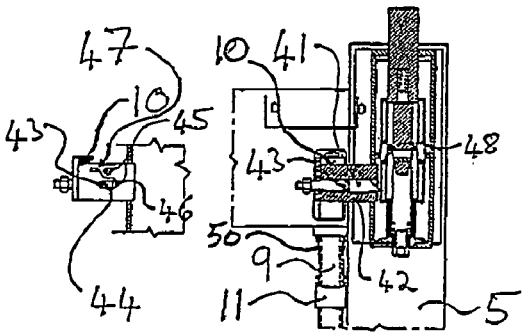
FIG. 6 is a cross-sectional view along the line C—C of FIG. 3.
Figure 4:
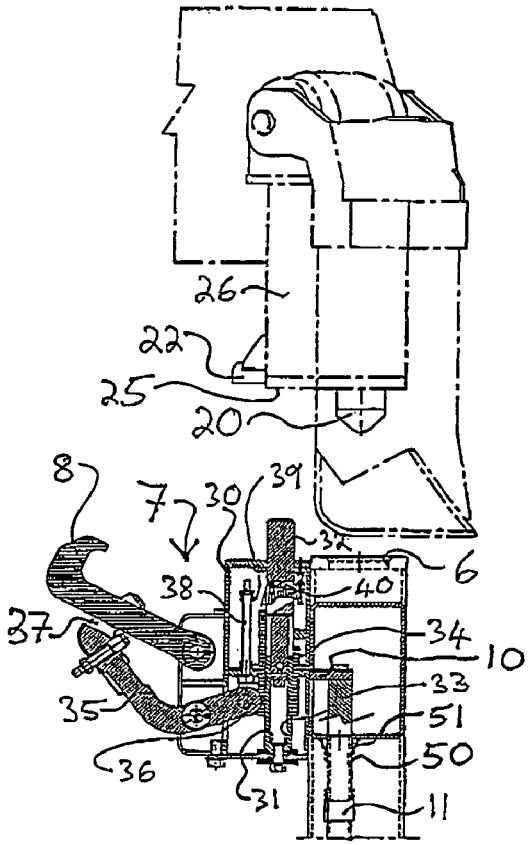
FIG. 4 is a cross-sectional view along the line A—A of FIG. 3.
Figure 4:
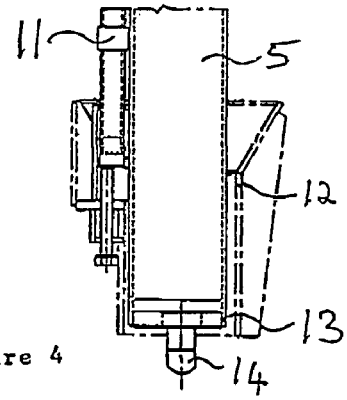
Figure 5:
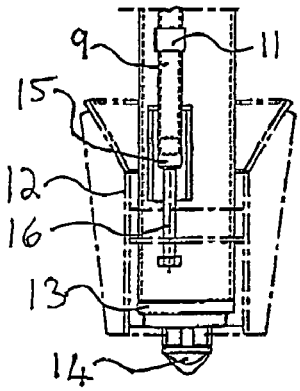
FIG. 5 is a cross-sectional view along the line B—B of FIG. 3.

The latch mechanism 7 mounted to each of the legs 5 includes a housing 30 in which is mounted a support member 31. Slidably mounted within the support member 31 is an actuating member 32, which is biased to the position shown in FIGS. 1, 2, 5 and 4 by a helical spring 33. Slidably mounted on the outer surface of the support member 31 is a sleeve 34 which is pivotally coupled to an intermediate linkage 35 a pivot point 36 in one end of the linkage 35. The other end of the linkage 35 includes a slot 37 through which the latch member 8 extends. The sleeve 34 is connected a rod 38 which has a helical spring 39 mounted thereon to bias the sleeve 34, linkage 35 and latch member 8 to the position shown in FIGS. 1 and 5. The sleeve 34 includes a dock recess 48. Pivotally mounted within the actuating member is a dog 40. As shown in FIGS. 3 and 4, the latch mechanism 7 also includes a lock member 41 slidably mounted in housing 42. Mounted on the lock member 41 is a release pin 43 which extends through a side wall of the housing 42 in slot 44, and a pivotally mounted member 45, pivotally mounted on the external surface of the housing 42. The member 45 includes a pin engaging surface 46 and a lever portion 47.

Figure 8:
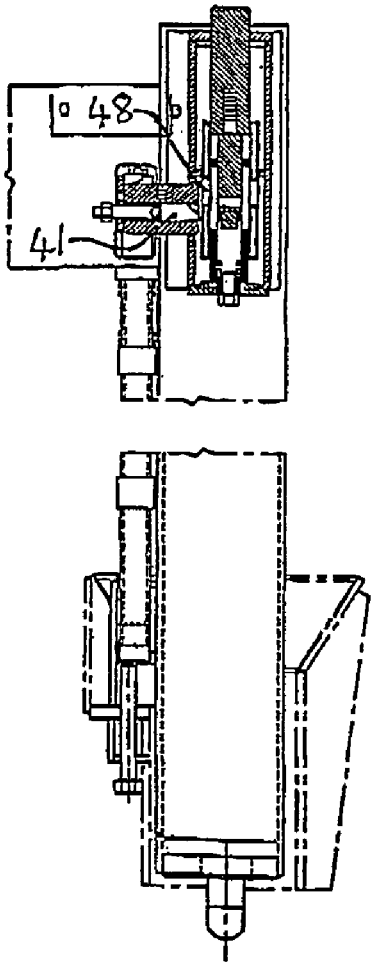
FIG. 8 is a cross-sectional view similar to the cross-sectional view of FIG. 4 but with the spreader partly landed on the overheight attachment.
Figure 7:
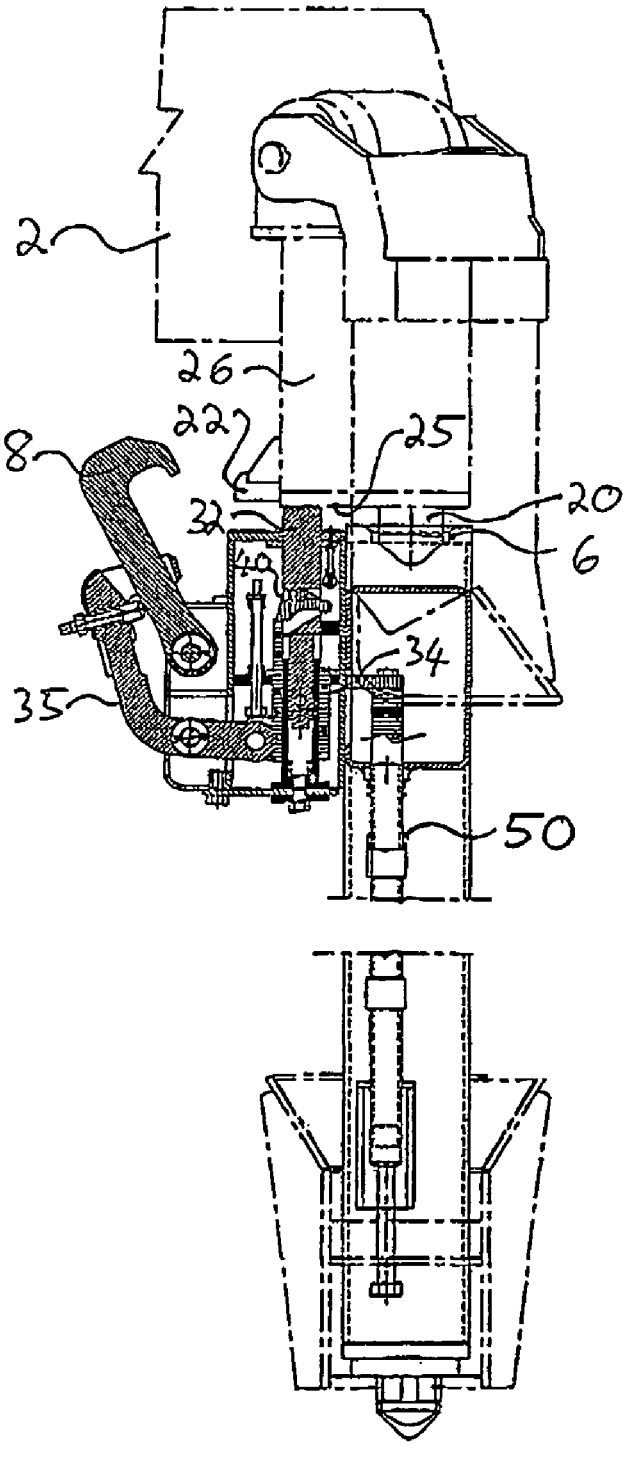
FIG. 7 is a cross-sectional view similar to the cross-sectional view of FIG. 5 but with the spreader partly landed on the overheight attachment.

In operation, the overheight attachment can be used to pick up a flat pallet by first lowering the spreader 21 into engagement with the overheight attachment 1 mounted on the base frame 2. FIGS. 7 and 8 show the spreader 2 being landed on the overheight attachment 1 with the twistlocks 20 partially engaged with the twistlock aperture 6. In this position, the actuating member 32 is partially depressed by bottom surface 25 of the twistlock corner 26 and movement of the actuating member 32 to this position causes the dog 40 to engage against the upper end of the sleeve 34 to push the sleeve 34 downwards against the biasing action of the spring 39 and move the linkage 35 and latch member 8 to the position shown in FIG. 7. From FIG. 8, it will be noted that the lock member 41 is still in the same position as shown in FIG. 4 and the lock recess 48 is above the lock member 41.

Figure 9:
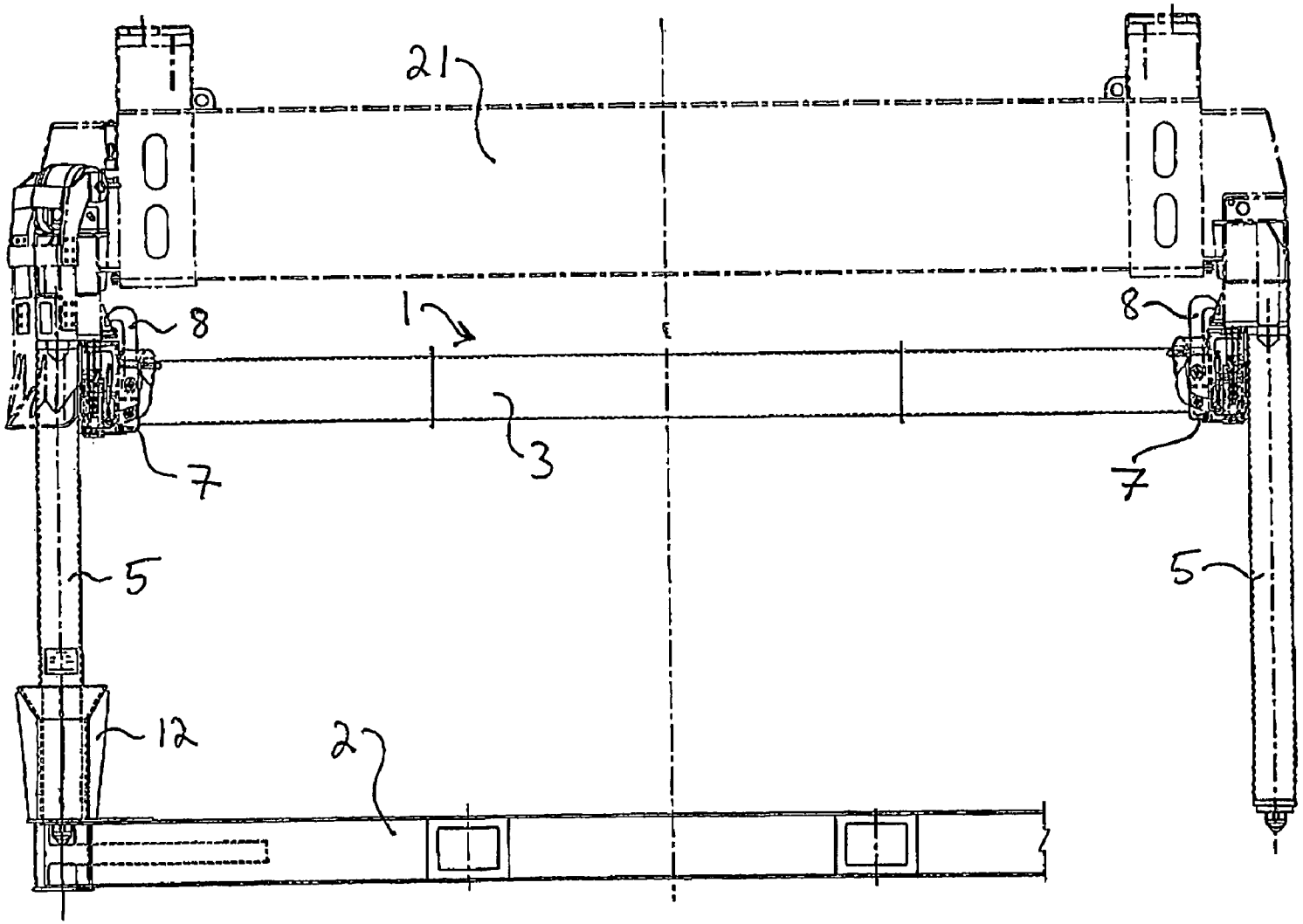
FIG. 9 is a side view similar to FIG. 1 but showing the spreader fully landed on the overheight attachment.
Figure 11:
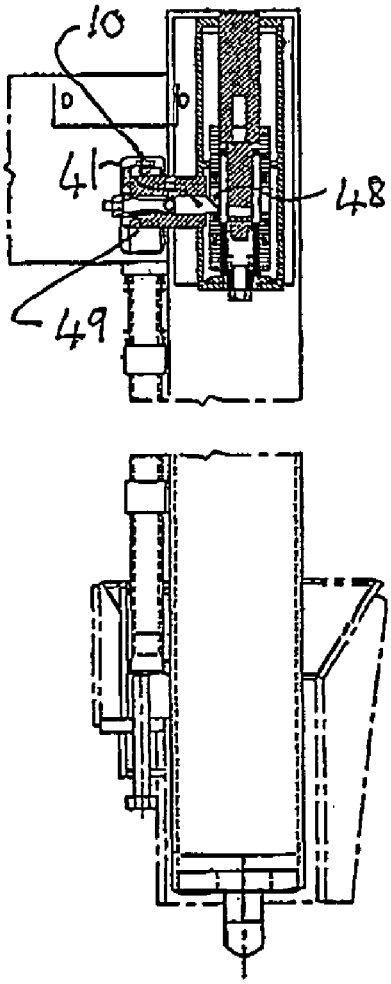
FIG. 11 is a cross-sectional view similar to FIG. 4 but with the spreader fully landed on the overheight attachment.
Figure 10:
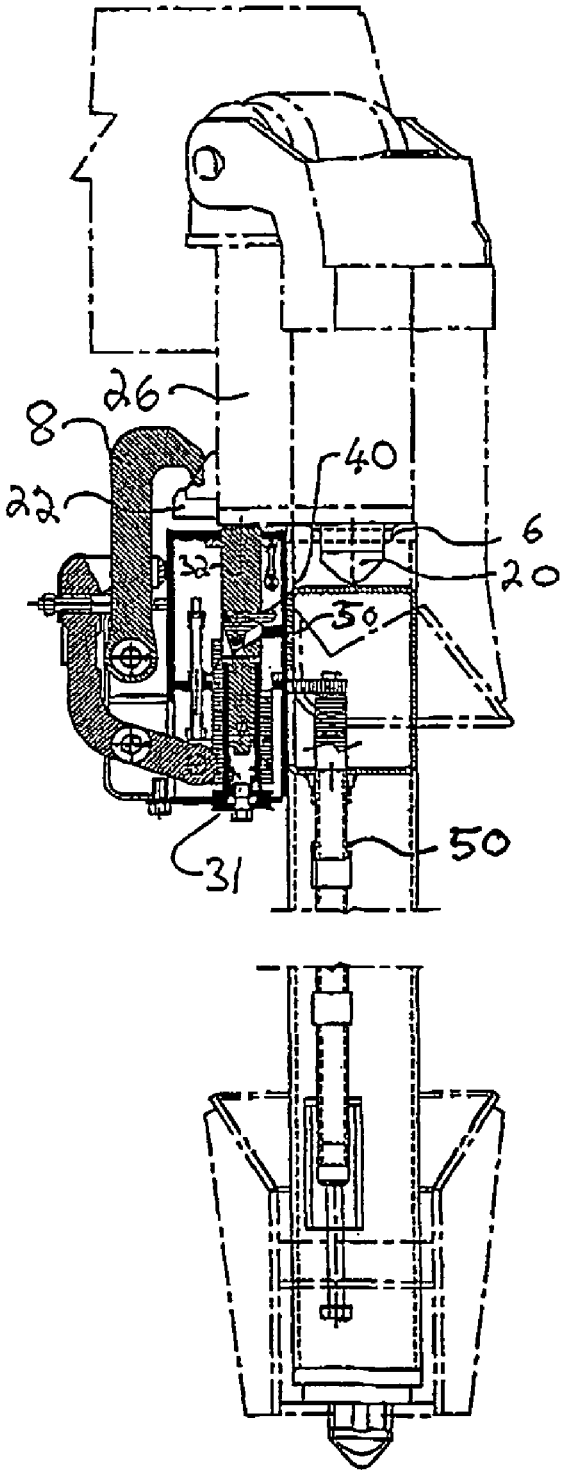
FIG. 10 is a cross-sectional view similar to the cross-sectional view of FIG. 5 but with the spreader fully landed on the overheight attachment.

As the spreader 21 is fully landed onto the overheight attachment 1 so that the twistlocks 20 are fully engaged in the twistlock aperture 6, as shown in FIGS. 9 and 10, the actuating member 32 is fully depressed to the position shown in FIGS. 10 and 11. In this position the lock recess 48 is aligned with the lock member 41 so that the lock member 41 slides into the lock recess 48 under the action biasing spring 49, and the dog 40 is rotated out of engagement with the sleeve 34 by shoulder 50 on the housing 30 hitting the dog 40 and pivoting it to the position shown in FIG. 10.

Figure 12:
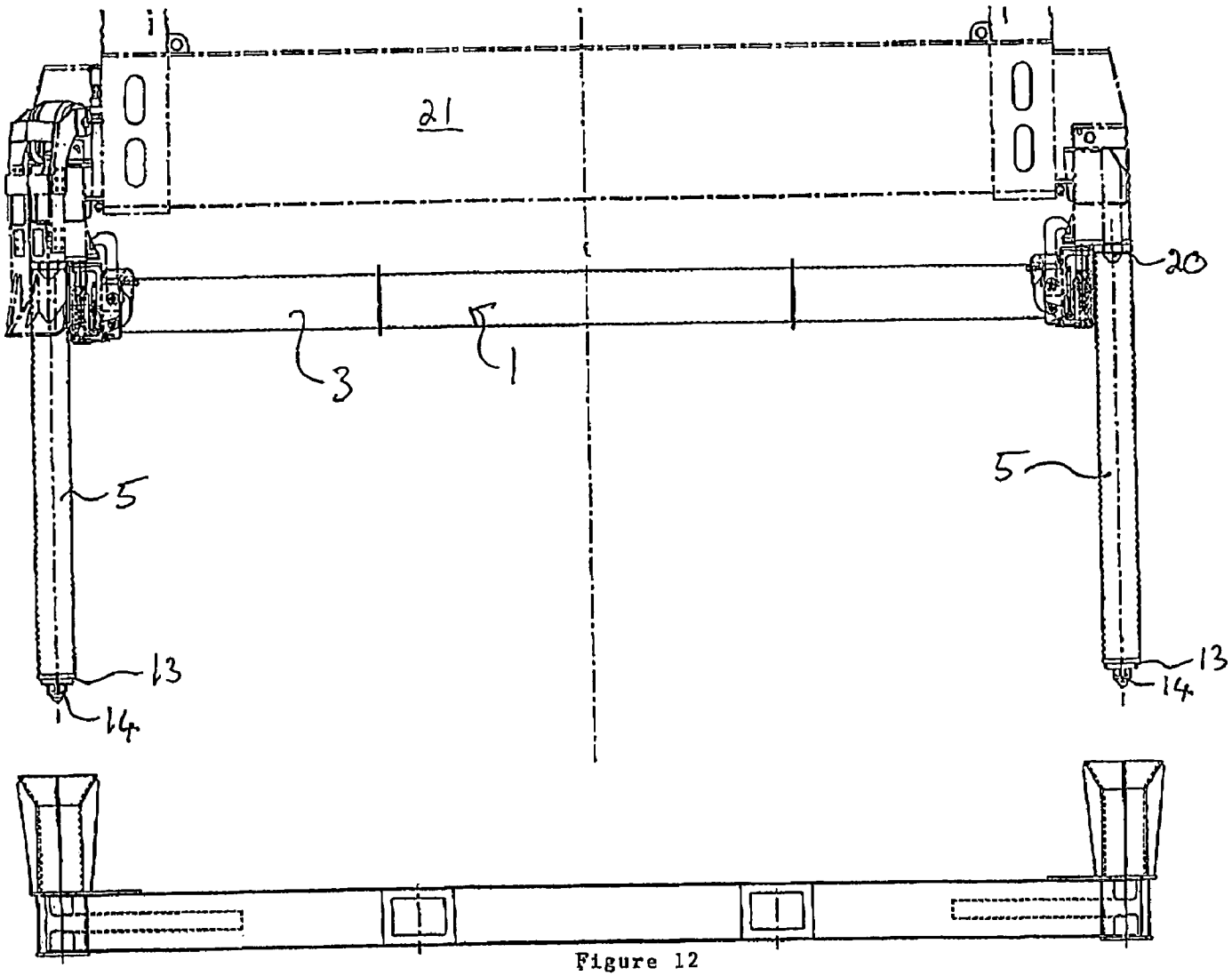
FIG. 12 is a side view similar to FIG. 1 but with the spreader latched to the overheight attachment and the overheight attachment and spreader lifted away from the base frame.
Figure 15:
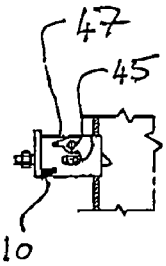
FIG. 15 is a cross-sectional view similar to the cross-sectional view of FIG. 6 but with the spreader and overheight attachment lifted away from the base frame.
Figure 14:
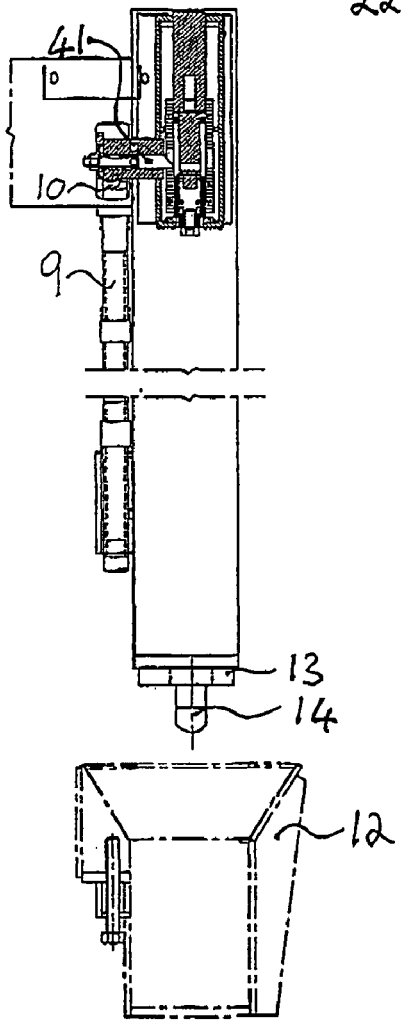
FIG. 14 is a cross-sectional view similar to the cross-sectional view of FIG. 11 but with the spreader and overheight attachment lifted away from the base frame.
Figure 13:
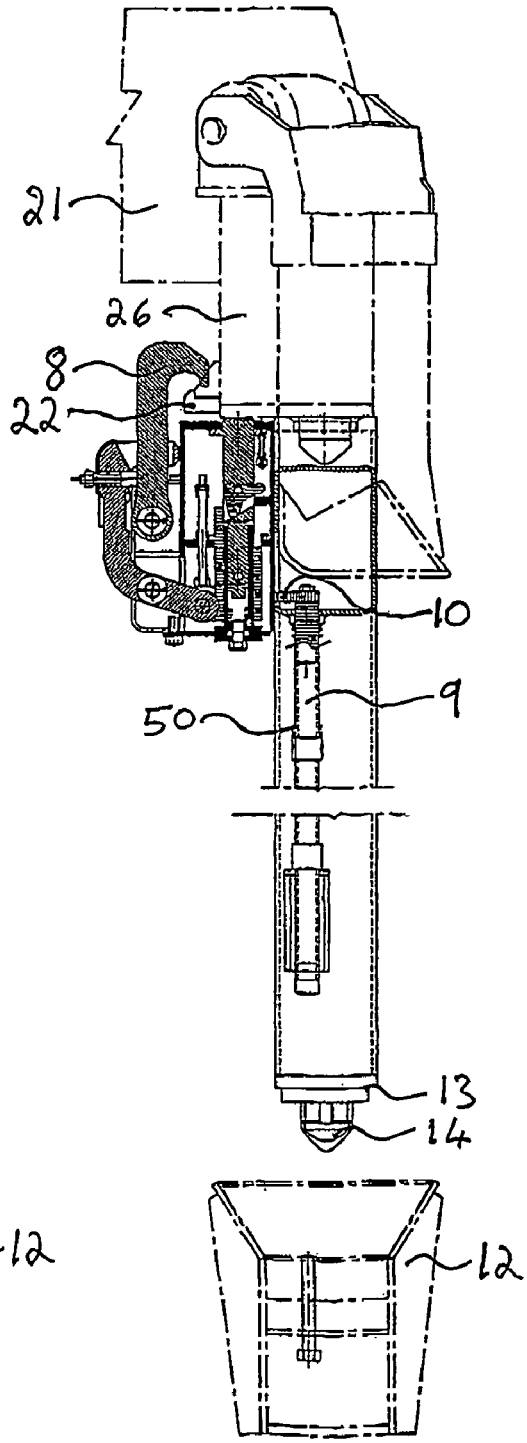
FIG. 13 is a cross-sectional view similar to the cross-sectional view of FIG. 10 but with the spreader and overheight attachment lifted away from the base frame.

In this position, the sleeve 34, linkage 35 and latch member 8 are locked in the position shown in FIG. 10 by the lock member 41 engaging with the lock recess 48. Hence, when the spreader 2 is hoisted upwards, the twistlock corners 26 lift off the overheight spreader until the latch formation 22 engages with the latch member 8. In this position the actuating member 32 will have risen slightly due to the action of the biasing spring 31 but the twistlocks 20 will still be engaged with the twistlock apertures 6. As the spreader 21 and overheight attachment 1 are lifted, the lower ends 13 and twistlock elements 14 disengage from the leg receiving sections 12 and the end 15 of the push rod 9 will disengage from the stop 16. As the overheight attachment 1 is lifted upwardly by the spreader 21, the push rod 9 will move, under the influence of the spring 50 and gravity, downwards with respect to the latch mechanism 7, such that the lever 10 also moves downwardly, past the lever portion 47 on the member 45, to the position shown in FIGS. 13, 14 and 15 in which the lever 10 is located below the lever portion 47 of the member 45. FIG. 12 shows the spreader 21 and overheight attachment 1 lifted clear of the base frame 2.

Figure 18:
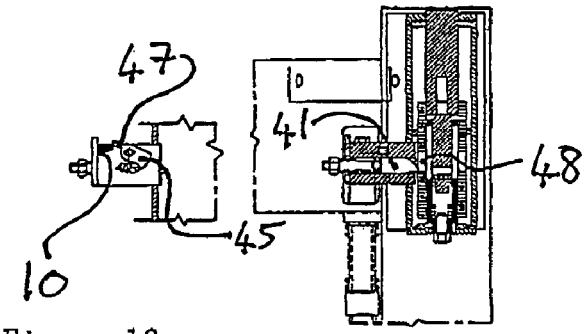
FIG. 18 is a cross-sectional view similar to the cross-sectional view of FIG. 15 but with the spreader and overheight attachment partially re-engaged with the base frame.
Figure 17:
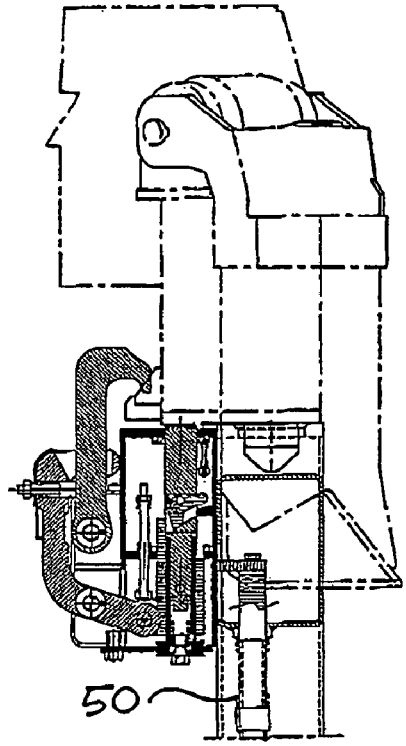
FIG. 17 is a cross-sectional view similar to FIG. 14 but with the spreader and overheight attachment partially re-engaged with the base frame.
Figure 17:
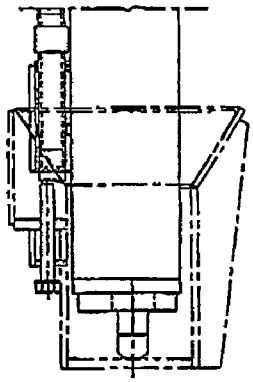
Figure 16:
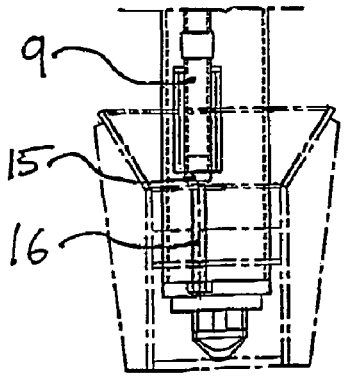
FIG. 16 is a cross-sectional view similar to FIG. 13 but with the overheight attachment partially re-engaged with the base frame.

The overheight attachment 1 is now positively secured to the spreader 21 by means of the latch members 8 engaging with the latch formations 22 on each of the twistlock corners 26. Therefore, the combination of the spreader 21 and the overheight attachment 1 can be used to pick up cargo secured to a flat pallet, as the cargo on the flat pallet will be located between the legs 5 and the cross member 3. When the twistlock elements 14 on the ends 13 of the legs 5 are located in corresponding twistlock apertures on a pallet, they can be rotated to lock the pallet to the legs 5 by rotation of the twistlocks 20 on the spreader 21. The legs 5 have an internal mechanism which rotationally couples the twistlocks 20 to the twistlocks 14 when the twistlocks 20 are engaged in the twistlock apertures 6. Such a mechanism may be a conventional mechanism used in conventional overheight attachments to couple the twistlocks on the spreader to the twistlocks on the overheight attachment. After the pallet with cargo has been moved to the desired location, the spreader and overheight attachment can be disengaged from the pallet by counter-rotating the twistlocks 20 on the spreader 21 to counter-rotate the twistlocks 14, to enable the spreader 21 and overheight attachment 1 to be lifted away from the pallet. In addition to picking up cargo secured to a flat pallet, the overheight attachment may also be used to pick up an open top container or a flatrack container where there is cargo protruding above the open top or above the end frames of the flatrack and would obstruct a conventional spreader, such as the spreader 21, engaging with the twistlock apertures on the open top container or the flatrack container When it is desired to remove the overheight attachment 1 from the spreader 21, the overheight attachment 1 is lowered onto the base frame 2 such that the lower ends 13 of the legs 5 and the twistlocks 14 re-engaged with the leg receiving sections 12 of the base frame 2, as shown in FIGS. 16, 17 and 18. As the lower ends 13 enter the leg receiving sections 12, the lower ends 15 of the push rods 9 buts against the stops 16 and further lowering of the overheight attachment 1 onto the base frame 2 causes relative upward movement of the push rods 9 relative to the latch mechanisms 7 and compresses the spring 50 on each push rod 9. This relative movement of the push rods 9 moves the lever 10 upwards to strike the lever portion 47. This upward motion of the lever 10 rotates the member 45 and pushes the surface 46 against the pin 42 to move the pin 43 in the slot 44 to withdraw the lock member 41 from the lock recess 48.

Figure 21:
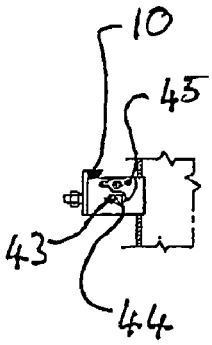
FIG. 21 is a cross-sectional view similar to FIG. 18 but with the overheight attachment and the spreader fully re-engaged with the base frame.
Figure 20:
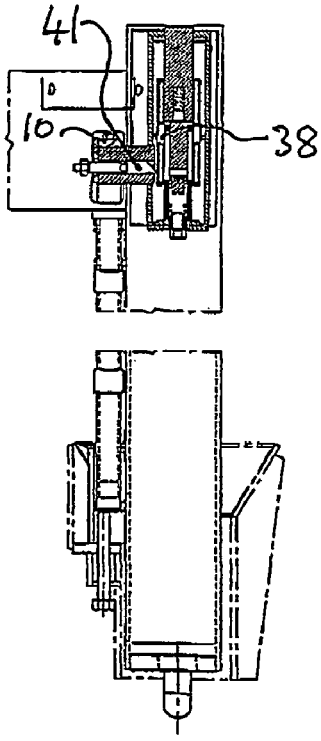
FIG. 20 is a cross-sectional view similar to FIG. 17 but with the spreader and overheight attachment fully re-engaged with the base frame.
Figure 19:
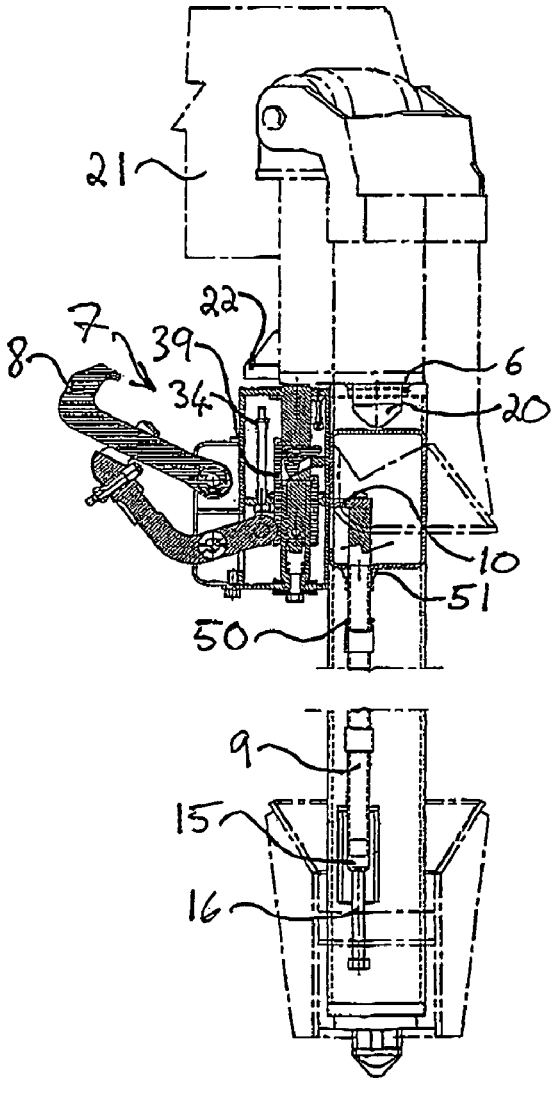
FIG. 19 is a cross-sectional view similar to the cross-sectional view shown in FIG. 16 but with the overheight attachment fully re-engaged with the base frame.

When the overheight attachment 1 is fully lowered (or landed) onto the base frame 2, the lever 10 has rotated the member 45 until the pin 43 is pushed to the left hand end of the slot 44 and the lock member 41 is fully retracted from the lock recess 48. This permits the sleeve 34 to move upwards to the position shown in FIGS. 19 and 20 under the biasing action of the spring 39, which in turn causes the latch member 8 to be disengaged from the latch formation 22. When the overheight attachment 1 is fully landed on the base, the lever 10 moves to the position shown in FIG. 21, which is the same position in which the lever 10 is located in FIGS. 5 and 6.

Figure 22:
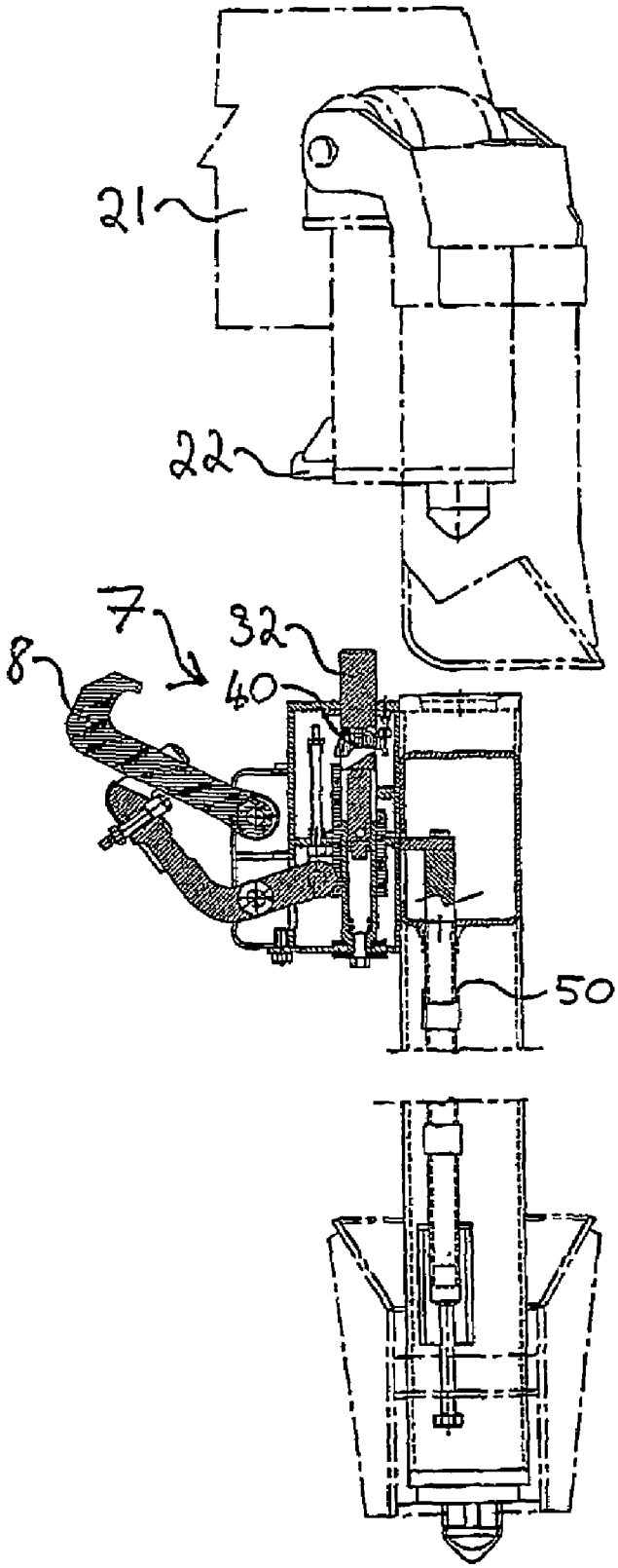
FIG. 22 is a cross-sectional view similar to the cross-sectional view shown in FIG. 19 but with the spreader disengaged from the overheight attachment.

Therefore, when the spreader 21 is lifted, the twistlocks 20 withdraw from the twistlock apertures 6, provided that the twistlocks 20 are in the counter-rotated position, and the actuating member 32 and dog 40 move to the position shown in FIG. 22. In this position, the latch mechanism 7 is in an identical position to that shown in FIGS. 1 to 6. That is, the position in which the spreader 21 can be re-engaged with the overheight attachment 1 and the latch mechanism 7 actuated to cause the latch member 8 to engage with the latch formation 22.

Hence, the invention has the advantage of permitting a spreader 21 to be secured to an overheight attachment without requiring manual intervention and enables the overheight attachment to be automatically latched to the spreader 21 merely by landing the spreader 21 onto the overheight attachment 1 in a single operation. Similarly, the invention permits the overheight attachment to be released from the spreader 21 merely by returning the overheight attachment to the base frame in a single operation.

In addition, by mounting the operating member 34 and the actuating member 32 so that they are movably mounted on each other, permits the number of components in the latch mechanism 7 to be reduced and facilitates relatively smooth operation of the latch mechanism.

The invention claimed is:

1. A latch mechanism comprising a latch member movable between a release position and a latched position, an operating member and an intermediate link formed as a pivoting lever arm, the intermediate link being pivotally coupled to the operating member and slidably coupled to the latch member, the operating member being movable between a first position and a second position, the latch member being in the release position when the operating member is in the first position and the latch member being in the latched position when the operating member is in the second position, an actuating member movable from a first position to a second position, movement of the actuating member from the first position to the second position causing the operating member to move from the first position to the second position to move the latch member from the release position to the latched position, a lock member movable between a disengaged position and an engaged position in which the lock member locks the operating member in the second position, the lock member moving from the disengaged position to the engaged position when the operating member is moved from the first position to the second position, and a release member movable between a first and a second position, movement of the release member from the first position to the second position, when the lock member is in the engaged position, causing the lock member to move from the engaged to the disengaged position to permit the operating member to move from the second position to the first position, and wherein the actuating member and the operating member are movably mounted on each other.

2. A latch mechanism according to claim 1, wherein the actuating member and the operating member are slidably mounted on a support member.

3. A latch mechanism according to claim 2, wherein the actuating member and the operating member are concentrically mounted on the support member.

4. A latch mechanism according to claim 1, wherein the operating member is biased to the first position.

5. A latch mechanism according to claim 1, wherein the actuating member is biased to the first position.

6. A latch mechanism according to claim 1, wherein the release member is biased to the first position.

7. A latch mechanism according to claim 1, wherein the actuating member includes an engagement member which is movable between a first position in which the engagement member is adapted to engage with the operating member, and a second position in which the engagement member is disengaged from the operating member when the actuating member is in the second position.

8. A latch mechanism according to claim 1, wherein the lock member is biased to the engaged position.

9. An overheight attachment for a spreader comprising a latch mechanism in accordance with claim 1.

10. A system for handling cargo comprising a spreader and an overheight attachment in accordance with claim 9, the spreader actuating the actuating member, when the spreader is engaged with the overheight attachment, to move the actuating member from the first to the second position to engage the latch member with a latching formation on the spreader.

* * * * *